United States Patent [19]

Mishima

[11] 4,103,116

[45] Jul. 25, 1978

[54] PICKUP CARTRIDGE WITH MOVING MAGNET ARMATURE

[75] Inventor: Hitoshi Mishima, Hamamatsu, Japan

[73] Assignee: Nippon Gakki Seizo Kabushiki Kaisha, Hamamatsu, Japan

[21] Appl. No.: 637,149

[22] Filed: Dec. 3, 1975

[30] Foreign Application Priority Data

| | | | |
|---|---|---|---|
| Dec. 5, 1974 | [JP] | Japan | 49-140345 |
| Dec. 5, 1974 | [JP] | Japan | 49-140346 |
| Dec. 5, 1974 | [JP] | Japan | 49-140347 |
| Dec. 5, 1974 | [JP] | Japan | 49-140348 |

[51] Int. Cl.[2] ..... H04R 11/12

[52] U.S. Cl. ..... 179/100.41 M; 179/100.41 K; 274/37

[58] Field of Search ..... 179/100.41 M, 100.41 D, 179/100.41 Z, 100.41 K; 274/37

[56] References Cited

U.S. PATENT DOCUMENTS

| | | | |
|---|---|---|---|
| 2,379,782 | 7/1945 | Bobb | 179/100.41 D |
| 3,576,955 | 5/1971 | Obata | 179/100.41 M |
| 3,614,332 | 10/1971 | Nagasaki | 179/100.41 K |
| 3,627,931 | 12/1971 | Matsuda | 179/100.41 M |
| 3,694,586 | 9/1972 | Grado | 179/100.41 Z |
| 3,700,829 | 10/1972 | Anneberg | 179/100.41 Z |
| 3,760,125 | 9/1973 | Laue | 179/100.41 Z |
| 3,904,837 | 9/1975 | Sugimoto | 179/100.41 M |

*Primary Examiner*—Bernard Konick
*Assistant Examiner*—Alan Faber
*Attorney, Agent, or Firm*—Cushman, Darby & Cushman

[57] ABSTRACT

A pickup cartridge of the moving magnet type. The vibration center of its vibrating system is stabilized by being concentrated at a certain point without appreciable fluctuations, regardless of the vibration amplitude of the vibrating system. Also, it has a very high conversion efficiency of its displacement-magnetism converting system for converting the positional changes of this vibrating system to changes in magnetism. This conversion efficiency is almost constant regardless of the vibration amplitude of the vibrating system.

A damping member is interposed between an armature magnet and a member for supporting this armature magnet. A cantilever attached to the magnet is pulled, jointly with the armature magnet, by a tension wire connected to the base of this cantilever, toward the supporting member in the axial direction of the cantilever. The base end of the cantilever is positioned substantially at the center of that surface of the armature magnet which faces the supporting member via the damping member. The other surface of the armature magnet faced by the pole pieces of the displacement-magnetism converting system is a plane having a substantially constant radius of curvature centering around the base of the cantilever.

17 Claims, 13 Drawing Figures

PICKUP CARTRIDGE WITH MOVING MAGNET ARMATURE

BACKGROUND OF THE INVENTION (a) Field of the Invention

The present invention concerns a pickup cartridge for picking up a signal recorded on a record disc, and more particularly it pertains to a pickup cartridge of the moving magnet type.

(b) Description of the Prior Art

A pickup cartridge of the moving magnet type, in general, is constructed so that an armature magnet is arranged between pole pieces which constitute a part of a closed magnetic path containing this magnet and that the magnet is supported so as to be able to move or vibrate jointly with a cantilever.

In a known pickup cartridge of the aforesaid type, it has been usual to arrange so that a magnet which is secured to a cantilever is formed into a disc or a columnar shape; that the cantilever and the magnet which are thus integral with each other are supported between pole pieces via an elastic damping member; and that the cantilever is pulled by a suspension wire such as piano string to suppress the tendency of this cantilever of making a longitudinal displacement. In such an arrangement of the prior art, the center of vibration of the vibrating system containing the cantilever, the armature magnet, the damping member and the suspension wire tends to move depending on the amplitude of vibration of the vibrating system. Furthermore, the distance between the pole pieces and the magnet tends to vary depending on the amplitude of vibration of the vibrating system. Accordingly, the pickup cartridge having the aforesaid arrangement is not able to faithfully pick up the signal recorded on a record disc without causing distortion of the signal. Moreover, owing to the fact that the distance between the pole pieces and the armature magnet can vary depending on the armature magnet of the vibration amplitude of the vibrating system, it is not possible to arrange the pole pieces so as to face the armature magnet at positions sufficiently close thereto. Thus, the pickup cartridge having such an arrangement as described above is not able to pick up the recorded signal of the record disc with good sensitivity.

SUMMARY OF THE INVENTION

It is, therefore, a primary object of the present invention to provide a pickup cartridge which faithfully and efficiently, i.e. with a high sensitivity, picks up the signal recorded on a record disc.

Another object of the present invention is to provide a pickup cartridge of the type described above, which has an enchanced compliance and which is able to stably trace the signal groove of the record disc.

Still another object of the present invention is to provide a pickup cartridge of the type described above, which has a simpified and yet tough and strong structure.

A further object of the present invention is to provide a pickup cartridge of the type described above, which is easy to replace the whole vibrating system containing a cartridge.

These and other objects as well as the features of the present invention will become apparent by reading the following detailed description of the preferred embodiments when taken in conjunction with the acompanying drawings.

BRIEF DESCRIPTION OF THE DRAWINGS

Like parts are indicated by like reference numerals throughout the drawings.

DETAILED DESCRIPTION OF THE PREFERRED EMBODIMENTS

According to the present invention, the base end of a cantilever is positioned at substantially the center of the first surface of an armature magnet to which the base portion of the cantilever is fixed, said first surface facing, via a damping member, a supporting member for supporting the armature magnet. The base end of the cantilever is held so as to be substantially constant relative to the supporting member by a position insuring means such as a suspension wire. More specifically, the cantilever is pulled, jointly with said magnet, toward the supporting member in the axial direction of the cantilever by the suspension wire which is coupled to the base end of the cantilever. Owing to this simplified arrangement, the center of vibration of the vibrating system containing the cantilever, the armature magnet, the damping member and the suspension wire will become substantially in exact agreement with the position of the base end of the cantilever, and this center of vibration will not move regardless of the vibration amplitude of the vibrating system.

According to the present invention, the center portion of the first surface of the armature magnet, i.e. that portion of the magnet where the base end of the cantilever is positioned, is arranged to protrude toward the supporting member, and/or that portion of the supporting member which faces the center portion of the first surface of the magnet is arranged to protrude toward the armature magnet. Owing to such arrangement, it is possible to easily augment the compliance without sacrificing the stability of the vibration center of said vibrating system.

Furthermore, according to the present invention, the second surface of the armature magnet faced by at least a pair of pole pieces is formed to be a surface having a substantially constant radius of curvature centering around the base end of the cantilever, i.e. centering around the vibration center of the vibrating system. Said a pair of pole pieces constitutes a part of a closed magnetic path containing the armature magnet. For example, this second surface is formed into a spherical plane whose center is coincident with the vibration center of the vibrating system. Thus, the distance between the armature magnet and the pole pieces is held substantially constant irrespective of the vibration amplitude of the vibrating system. As a result, it is possible to arrange the pole pieces to face the armature magnet at positions substantially close to the armature magnet. Accordingly, there can be materialized a pickup cartridge having a highly enhanced sensitivity. Moreover, there can be produced a pickup cartridge which is able to faithfully pick up the recorded signal of the record groove without causing distortion of this signal.

Figure 1:
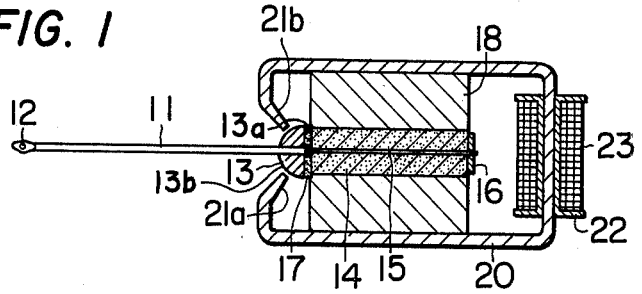
FIG. 1 is a horizontal sectional view showing an example of the pickup cartridge according to the present invention.
Figure 2:
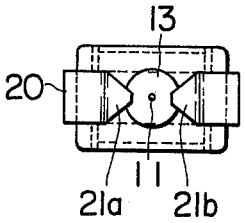
FIG. 2 is a front view of the pickup cartridge shown in FIG. 1.
Figure 3:
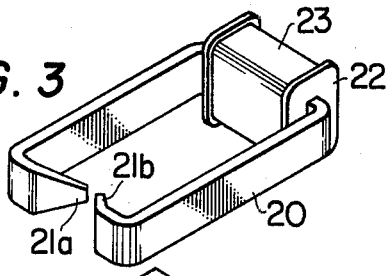
FIG. 3 is an exploded perspective view of the pickup cartridge shown in FIG. 1.

Referring now to FIGS. 1, 2 and 3, a basic example of the pickup cartridge according to the present invention will be explained hereunder. This example is given here to explain the basic arrangement of the pickup cartridge according to the present invention. This pickup cartridge can be used for monaural reproduction of a signal recorded on a record disc.

Reference numeral 11 represents a cantilever. On the underside of the foremost end portion of this cantilever 11 is secured a stylus tip or needle 12 which is assigned for tracing the signal groove of a record disc. This cantilever 11 may be formed from, for example, a tube, which is made of a light material such as light aluminum alloy or beryllium alloy having a relatively large Young's modulus. The base portion of the cantilever 11 is received and secured within an armature magnet 13. This armature magnet 13 is arranged to make movements or vibrations jointly with the cantilever 11. In this example, this armature magnet 13 is formed into a substantially semi-spherical shape. This armature magnet 13 may be made with a permanent magnet material, such as a ferrite or a permalloy, having a high magnetic permeability and a large coercive force. This armature magnet 13 is supported on a supporting member 14 by a suspension system which is comprised of a suspension wire 15 and a damping member 17.

The base end of said cantilever 11 is positioned at substantially the center of a first surface 13*a* of the armature magnet 13. This first surface 13*a* is a surface which faces the supporting member 14 via the damping member 17. It should be understood that said base end of the cantilever 11 may slightly protrude toward the supporting member 14 side from said first surface 13*a* of the armature magnet 13. The cantilever 11, in turn, is pulled by the suspension wire 15 in its axial direction jointly with the armature magnet 13 toward the supporting member 14. Said suspension wire 15 is intended to secure or hold the position of the base end of the cantilever 11 substantially constant with respect to the supporting member 14. By this arrangement, the tendency of displacement of the cantilever 11 in the direction of the foremost end thereof is suppressed. It should be noted, however, that this suspension wire 15 is unable to serve to inhibit the swinging movement or vibration of the cantilever 11, and that it is a wire made of a material, such as a piano string, having a flexibility and having a small elongability. One end of this suspension wire 15 is coupled to the base end of the cantilever 11 and the other end thereof is fixed to one end of the supporting member 14 by a stopper 16. The damping member 17 is intended to suppress or damp, to an appropriate extent, the swinging movements or the vibrations of both the cantilever 11 and the armature magnet 13. This damping member 17 is formed with an elastic material such as soft rubber having an appropriate flexibility and elasticity. The supporting member 14 may be made into a columnar member made with a material, such as a ferrite, having a high magnetic permeability. Desirably, this supporting member 14 is made with such a material as having an appropriate hardness and as ensuring an easy processing thereof. It should be understood that this supporting member can be made with a non-magnetic material such as plastics. A through-hole is formed through the center portion of this supporting member 14 for the insertion of said suspension wire 15.

With the aforesaid arrangement, the vibration center of that vibrating system of the pickup cartridge which is composed of the cantilever 11, the armature magnet 13, the damping member 17 and the suspension wire 15 is positioned at substantially the base end of the cantilever 11. And, this center of vibration will not fluctuate but it will be maintained extremely stable, regardless of the vibration amplitude of the vibrating system, i.e. regardless of the magnitude of the angle of swing of the cantilever 11.

The supporting member 14 which supports the vibrating system of the pickup cartridge via the suspension system is received and held within a through-hole 19 formed through the center of a holder 18 which is made with a non-magnetic material such as plastics. This holder 18 as a whole may be formed with a non-magnetic material as an integral body with said supporting member 14. A yoke 20 having a substantially U-shape is secured to this holder 18. The yoke 20, in turn, is intended to constitute a part of the closed magnetic path containing the armature magnet 13, and it is made with a magnetic material having a high magnetic permeability. It should be understood that this yoke 20 is magnetically insulated from the armature magnet 13 by said holder 18. The opposite ends of this yoke 20 are bent inwardly to provide pole pieces 21*a* and 21*b*. These pole pieces 21*a* and 21*b* are arranged to face a second surface 13*b* of the armature magnet 13 at positions close to this surface 13*b*. This second surface 13*b* is a surface which does not face the supporting member 14, and this surface does not include that portion which receives the cantilever 11. Said pair of pole pieces 21*a* and 21*b*, in general, are arranged symmetrically relative to the cantilever 11. Now, this instant example is intended to show a basic arrangement of the pickup cartridge of the present invention. Accordingly, the aforesaid pole pieces are provided in the form of a pair. In general, however, it is usual to provide two pairs of pole pieces in order to enable not only monaural reproduction but also streophonic reproduction of the recorded signal of a record disc. Such a usual arrangement will be mentioned later by referring to FIG. 5.

In this instant example, the armature magnet 13 is formed to have a semi-spherical shape. And, said second surface 13*b* of the armature magnet 13 is provided as a spherical surface centering around the base end of the cantilever 11, i.e. centering around the vibration center of the vibrating system of the pickup cartridge. Generally speaking, according to the present invention, the second surface 13*b* of the armature magnet 13 is provided as a surface having a substantially constant radius of curvature centering around the stable vibration center of the vibrating system. By so arranging, the distance between the tips of the pole pieces 21*a* and 21*b* and the armature magnet 13 is held constant regardless of the vibration amplitude of the vibrating system, i.e. the vibration angle of the cantilever 11. Accordingly, this arrangement will insure a constant efficiency of conversion which is conducted by the displacement-to-magnetism converting system assigned for converting the vibration, i.e. mechanical displacement, of the vibrating system to variations of magnetic flux, independently of the vibration amplitude of the vibrating system. Said displacement-to-magnetism converting system includes a yoke 20 having the pole pieces 21*a* and 21*b*, an air-gap between these pole pieces 21*a* and 21*b*, and the armature magnet 13. As such, the vibrations or movements of the cantilever 11, which are caused as the stylus tip traces the groove of the record disc, can be converted faithfully to variations of magnetic flux passing through the yoke 20 of the displacement-to-magnetism converting system. Thus, the signal recorded on the signal groove of the record disc can be picked up, without distortion, in the form of variations of magnetic flux. Also, owing to the fact that the distance between the tips of the pole pieces 21*a*, 21*b* and the armature magnet 13 is held constant irrelevantly of the vibration amplitude of the vibrating system, it is possible to sufficiently shorten this distance as compared with known pickup cartridges. As a result, the conversion efficiency of the displacement-to-magnetism converting system, i.e. the sensitivity of the cartridge, can be elevated markedly without any undesirable distortion of the picked-up signal.

A coil 23 is applied, via an insulating bobbin 22, around the intermediate portion of the yoke 20. This coil 23 is provided to induce a voltage corresponding to the variation of the magnetic flux which passes through the yoke 20. This yoke 20, as an integral body with said displacement-to-magnetism converting system, constitutes a displacement-to-electricity converting system. The signal which is picked up from the record disc is derived through said coil 23.

Figure 4:
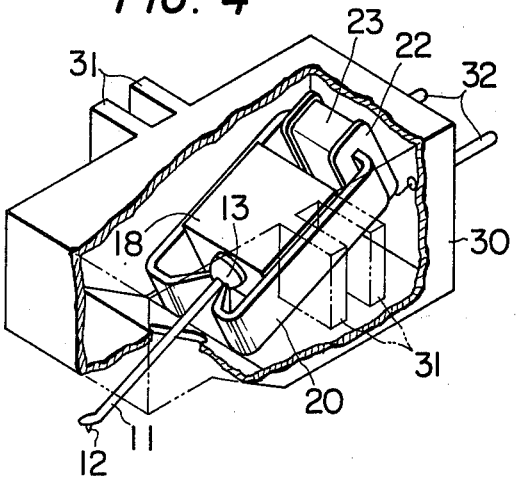
FIG. 4 is a perspective view, partly broken away, showing the manner in which the pickup cartridge of FIG. 1 is mounted within a shield casing.
Figure 4:
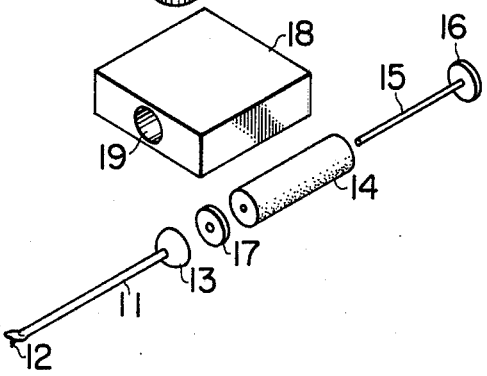

As shown in FIG. 4, the above-mentioned pickup cartridge is usually mounted within a shield casing 30 for practical purposes. This shield casing 30 is ordinarily formed so as to be easily attached to and detached from the head shell of the pickup arm. In this example, arrangement is provided so that two pairs of projecting walls 31, 31 and 31, 31 are provided on both sides of the casing 30 and that screws are passed between each of these two pairs of the projecting walls 31, 31 and 31, 31 from the head shell side, and that nuts are applied to the bottoms of these screws to thereby firmly fasten the shield casing 30 to the head shell. The voltage induced in the coil 23 is derived via pin terminals 32 and 32 extending from the head shell 30 and it is led to an amplifier of a sound reproducing system.

Figure 5:
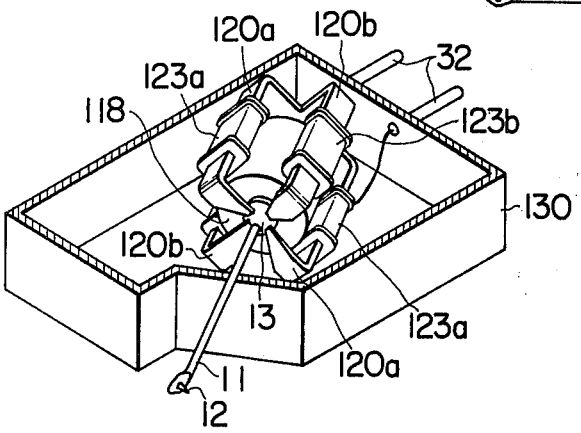
FIG. 5 is a perspective view, partly broken away, showing another example of the pickup cartridge according to the present invention.

In FIG. 5, there is shown another example of a pickup cartridge embodying the present invention. This example is a more practical embodiment of the present invention. In this instant example, there are provided right channel yokes 120*a* and 120*a* and left channel yokes 120*b* and 120*b*, all of which are arranged at right angle relative to each other, and a total of four coils 123*a*, 123*a*, 123*b*, 123*b* are applied around these respective yokes 120*a*, 120*a*, 120*b*, 120*b*, one coil for one yoke. These yokes 120*a*, 120*a*, 120*b*, 120*b* are united together at their intermediate portions. In other words, this example is intended to make stereophonic reproduction possible. Needless to say, at the foremost ends of the respective yokes 120*a*, 120*a*, 120*b*, 120*b* there are provided pole pieces facing the second surface 13*b* of the armature magnet 13, in the same way as that described with respect to the example of FIG. 1. Other than the foregoing, the arrangement of the cartridge of this example is substantially similar to that shown in FIGS. 1 through 4.

Figure 6:
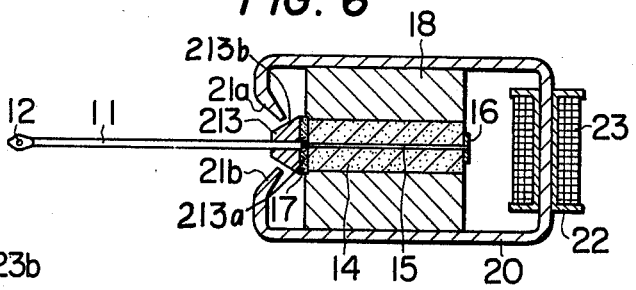
FIG. 6 is a horizontal sectional view showing still another example of the pickup cartridge according to the present invention.
Figure 7:
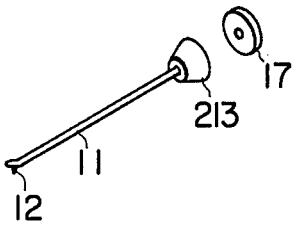
FIG. 7 is an exploded perspective view showing a part of the pickup cartridge of FIG. 6.

In FIGS. 6 and 7, there is shown still another example of the pickup cartridge according to the present invention. In this example, the fact that the vibration amplitude of the pickup cartridge is usually considerably small is taken into account, and accordingly the armature magnet 213 is of a shape which is somewhat different from that of the pickup cartridge shown in FIG. 1. More specifically, the armature magnet 213 of this example is formed into a substantially frusto-conical shape having its center axis agreeing with the center axis of the cantilever 11 and having its bottom surface representing the first surface 213*a* of the armature magnet 213 which faces the supporting member 15. And, the second surface 213*b* of this armature magnet 213 is arranged to face the pole pieces 21*a* and 21*b* at substantially right angle. In this example wherein the armature magnet 213 is formed to have such a shape as stated above, it should be understood that, under the conditions in which the vibration amplitude of the vibrating system of the cartridge is relatively small and in which the pole pieces 21*a* and 21*b* are arranged to face always the second surface 213*b* which is relatively narrow in breadth without being dislocated beyond the area of this second surface 213*b*, the distance between the tips of these pole pieces 21*a* and 21*b* and the armature magnet 213 is held substantially constant throughout normal vibration range of the vibrating system. Thus, it is possible to markedly reduce the distance between the tips of the pole pieces 21*a* and 21*b* and the second surface 213*b* of the armature magnet 213 as compared with known pickup cartridge. As a result, it is possible to attain a highly enhanced sensitivity and a low distortion characteristic both of which substantially correspond to those of the cartridges shown in FIGS. 1 through 4. In other words, it may be considered that the second surface 213*b* of the armature magnet 213 of this instant example represents an approximate curved surface of the second surface 13*b* of the armature magnet 13 in the examples shown in FIGS. 1 through 4. The pickup cartridge of this example can be used for monaural reproduction of a record disc signal. Needless to say, the pickup cartridge of this example is used usually in a shield casing, as stated previously with respect to FIG. 4. Furthermore, this pickup cartridge can be modified easily into one intended for stereophonic reproduction by a slight change of arrangement, such as the provision of two pairs of pole pieces in such a manner as shown in FIG. 5.

Figure 8:
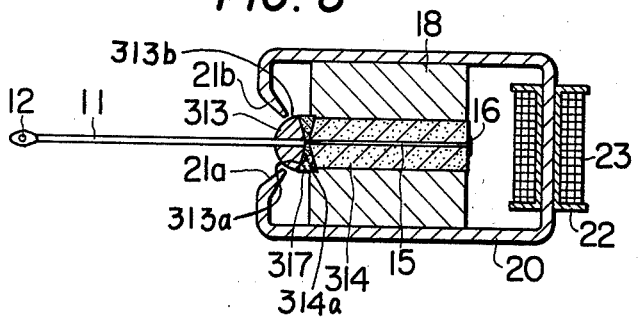
FIG. 8 is a horizontal sectional view showing yet another example of the pickup cartridge of the present invention.
Figure 9:
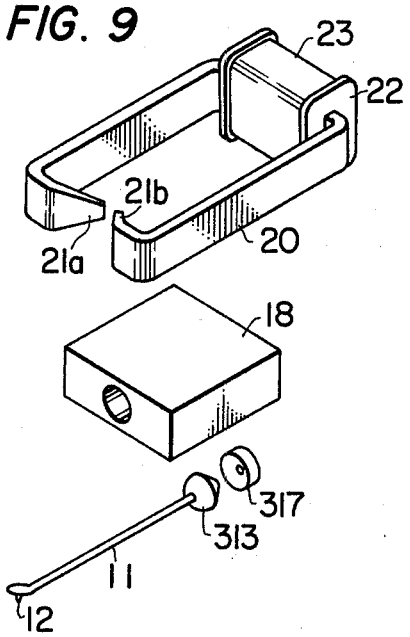
FIG. 9 is an exploded perspective view showing a part of the pickup cartridge of FIG. 8.

In yet another example of the pickup cartridge of the present invention shown in FIGS. 8 and 9, the first surface 313*a* of the armature magnet 313 of a substantially semi-spherical shape, i.e., that surface facing the supporting member 314, is formed into a conical surface projecting toward this supporting member 314. Also, in that portion of the supporting member 314 which faces the first surface 313*a* of the armature magnet 313, there is formed a conical surface 314*a* projecting toward the armature magnet 313. And, the damping member 317 which is provided between the first surface 313*a* of the armature magnet 313 and the conical surface 314*a* of the supporting member 314 is formed in such a way that its thickness decreases progressively as it goes toward its center from its marginal edges. The pickup cartridge of this instant example is arranged, as stated above, so that the damping member 317 has a progressively increasing thickness as it goes from its center toward the marginal edges. And, the vibration center of the vibrating system, which is substantially equal to the base end of the cantilever 11, is in agreement with the center of the damping member 317. Accordingly, the movement of the armature magnet 313 centering around the vibration center of the vibrating system is properly evenly controlled by the damping member 317 through a sufficiently large angle of the vibrations of the vibrating system containing the armature magnet 313. Furthermore, the arrangement of the damping member 317 which is sufficiently thin at its central portion can effectively suppress the fluctuation of the vibration center of the vibrating system. More specifically, the vibration center of the vibrating system should not fluctuate or should not be displaced. Accordingly, that portion of the flexible damping member 317 which corresponds to said vibration center can have a considerably small thickness. On the other hand, the other portions of the damping member 317 which face those portions of the first surface of the armature magnet 313 other than its central portion need to have a sufficient thickness. Such arrangement of thickness of the damping member 317 made of a flexible material makes this damping member undergo a compression of one region and an expansion of the opposing region of the damping member in accordance with the vibrations of the vibrating system even when the amplitude of the vibration is considerably great, while at the same time this damping member applying a proper damping force onto the first surface 313*a* of the armature magnet 313. Other than that stated above, the pickup cartridge of this example is substantially similar in construction to those examples shown in FIGS. 1 through 4. According to the arrangement of this example, a substantially great movement centering around the vibration center of the vibrating system is allowed under an optimum damping condition, without the development of an increase in the mechanical impedance of the vibrating system.

This example can be used for the monaural reproduction. However, it can be easily modified into one for stereophonic reproduction in much the same way as that discussed with respect to the preceding examples.

It should be understood that, as an alternative arrangement, only either one of the first surface 313*a* of the armature magnet 313 and the surface 314*a* of the supporting member 314 may be arranged to project. It should be understood also that the first surface 313*a* of the armature magnet 313 and the surface 314*a* of the supporting member 314 need not be formed into conical surfaces, but that they may have spherical surfaces or other surfaces of a desired shape.

Figure 10:
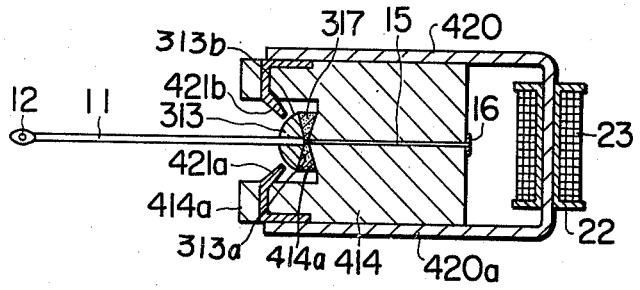
FIG. 10 is a horizontal sectional view showing a further example of the pickup cartridge according to the present invention.
Figure 11:
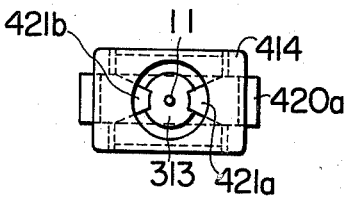
FIG. 11 is a front view of the pickup cartridge shown in FIG. 10.
Figure 12:
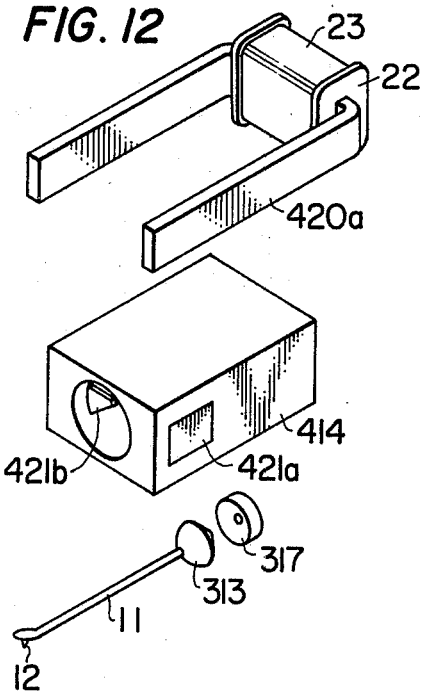
FIG. 12 is an exploded perspective view of the pickup cartridge shown in FIG. 10.

Next, description will hereunder be made on an example of the pickup cartridge embodying the present invention which makes it easy to replace the vibrating system containing the suspension system, by referring to FIGS. 10 through 12. The general arrangement of both the vibrating system and the suspension system of this instant example is practically the same as that shown in FIGS. 8 and 9. However, in the instant example, the supporting member 414 is made with a non-magnetic material such as a synthetic resin and it is formed into a square columnar shape. Moreover, the holder 18 mentioned in FIGS. 1 through 9 is not provided in the present example. The yoke 420 which, jointly with the armature magnet 313, constitutes a displacement-to-magnetism converting system is divided into a main magnetic path member 420*a* having a substantially U-shape and into pole pieces 421*a* and 421*b* which are to be magnetically coupled to the opposite ends of this member 420*a*. The pole pieces 421*a* and 421*b* are passed through the projecting marginal edge of the supporting member 414 and are secured thereto. Tips of these pole pieces 421*a* and 421*b* are arranged to face the second surface 313*b* of the armature magnet of 313 at positions close to this second surface 313*b*. Also, the base portion of the pole pieces 421*a* and 421*b* are arranged to be exposed on the outer surfaces of the supporting member 414. And, by securing the main magnetic path member 420*a* to the supporting member 414, and by bringing the two foremost end portions of this main magnetic path member 420*a* into contact with the base end portions of the pole pieces 421*a* and 421*b* thereby uniting them together magnetically, there is produced a complete position-to-magnetic flux converting system.

According to this example, there can be completed a pickup cartridge by initially separately assembling each of the two sections: (a) the vibrating system and a part of the displacement-to-magnetism converting system which require a very high precision in the assembling operation, and (b) the remaining parts, and then combining these two sections together. Thus, the assembling procedure of the pickup cartridge can be simplified. Also, as shown in FIG. 4, it is usual to use the pickup cartridge which is mounted within the shield casing 30. Moreover, the leads of the coil 23 are soldered to the terminal pins 32. And, therefore, the magnetism-to-electricity converting system including the coil 23 and the main magnetic path-constituting portion 420*a* of the yoke 420 is required to be fixed within a shield casing 30. However, the pickup cartridge of this example is constructed of two separate blocks: i.e. a block consisting of the main magnetic path member 420*a* and a coil 23; and the other block consisting of the pole pieces 421*a* and 421*b*, the vibrating system and the supporting system. These two blocks are each formed into an integral body, respectively, so that these two blocks can be easily separated from and united with each other. In this example, arrangement is provided so that the main magnetic path portion 420*a* or the arms of the yoke 420 is applied to both sides of the supporting member 414 so that these arms mechanically engage the supporting member 414 at the bilateral sides of this member 414; and that the inner end portions of these arms 420*a* and 420*a* of the yoke 420 engage those portions of the pole pieces 421*a* and 421*b* which are exposed from said bilateral sides of the supporting member 414. Thus, in case these two blocks are coupled together, the main magnetic path portions 420*a* and 420*a* are magnetically coupled, at their end portions, to the pole pieces 421*a* and 421*b*, respectively, thereby completing the displacement-to-electricity converting system.

As stated above, the pickup cartridge of this example is comprised of two separate unit which are mechanically and magnetically coupled together to form a complete pickup cartridge. One of such units is to be housed in the shield casing 30. The other unit is a block having a vibrating system including a stylus tip which requires to be replaced by a fresh one. This vibrating system, so to speak, is somewhat fragile. Therefore, the pickup cartridge of this example has the advantage that the replacement or repair of the aforesaid other one of the two units is simplified and is made easy.

The pickup cartridges shown in the examples of FIGS. 10 through 12 can be used for monaural reproduction. However, they can be modified into a more practical pickup cartridge as shown in FIG. 13.

Figure 13:
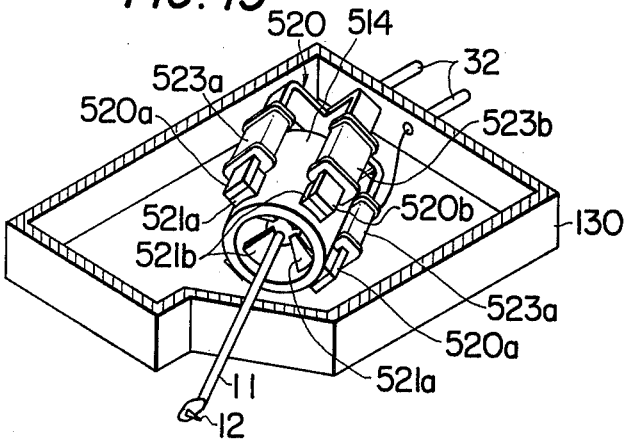
FIG. 13 is a perspective view, partly broken away, showing a still further example of the pickup cartridge according to the present invention.

The example of the pickup cartridge shown in FIG. 13 is intended to be used for stereophonic as well as monaural reproductions. In this example, there is provided a pair of main magnetic path portions 520*a* and 520*a* for right channel and another pair of main magnetic path portions 520*b* and 520*b* for left channel, all of which are arranged at right angle relative to each other. And, there are applied, around these portions of the yoke 520, a total of four coils 523*a*, 523*a*, 523*b*, 523*b*. Needless to say, there are provided two pairs of pole pieces 521*a*, 521*a* and 521*b*, 521*b* which are similar to those pole pieces shown in FIGS. 10 to 12. Each pair of these pole pieces constitutes, jointly with the aforesaid main magnetic path portions, the yoke 520 for two channels.

I claim:

1. A pickup cartridge comprising:

an armature formed as a permanent magnet;

a supporting member for supporting said armature magnet;

a damping member made with an elastic material for damping the movement of said armature magnet and positioned between said supporting member and a first surface of said armature magnet, which first surface facing said damping member;

a cantilever secured to said armature magnet and having its foremost end provided with a stylus tip and having its base end positioned at substantially the center of said first surface of the armature magnet;

position insuring means for insuring the position of the base end of said cantilever relative to said supporting member and permitting the free movement of said cantilever centering around said base end thereof;

pole pieces facing a second surface of said armature magnet at positions close to this second surface and arranged symmetrically with respect to said cantilever so that an area of each of said pole pieces facing said second surface of the armature magnet is constant irrespective of vibration of the armature magnet, which second surface does not face said damping members;

a yoke magnetically coupled to said pole pieces for constituting a closed magnetic path for the passage of the magnetic flux emitting from said armature magnet, said yoke being arranged at a specific position relative to said supporting member; and a coil applied around said yoke for inducing a signal corresponding to the variation of the magnetic flux passing through said yoke, said second surface of the armature magnet being a surface having a substantially constant radius of curvature centering around the base end of said cantilever, said pole pieces pointing to the base end of said cantilever and having end faces thereof facing said second surface of the armature magnet at postions close to this second surface.

2. A pickup cartridge according to claim 1, in which:

said position insuring means in a suspension wire for pulling said cantilever jointly with said armature magnet substantially in the axial direction of this cantilever toward said supporting member.

3. A pickup cartridge according to claim 2, in which:

said suspension wire is made with a flexible material having a small elongability and having one end coupled to the base end of said cantilever and the other end fixed to said supporting member.

4. A pickup cartridge according to claim 1, in which:

said first surface of the armature magnet represents a flat surface facing substantially parallel to said supporting member, and said second surface of the armature magnet represents a spherical surface centering around the base end of said cantilever.

5. A pickup cartridge according to claim 1, in which:

said yoke is of a substantially U-shape, and said pole pieces are formed integrally with said yoke by bending the two end portions of said yoke substantially toward the base end of said cantilever.

6. A pickup cartridge according to claim 1, in which:

said first surface of the armature magnet represents a surface projecting progressively toward said supporting member as it goes from its marginal edge portion toward its center, and said damping member has a thickness progressively increasing as it goes from its center portion toward its marginal edge portion.

7. A pickup cartridge according to claim 1, in which:

that surface of said supporting member which faces said first surface of the armature magnet is formed into a convex surface progressively projecting toward said armature magnet of this surface approaches close to the base end of said cantilever, and said damping member has a thickness progressively increasing as it goes from its center toward its marginal edge portion.

8. A pickup cartridge according to claim 7, in which:

said convex surface of the supporting member represents a conical surface having its apex located at its portion facing the base end of said cantilever, and said damping member has a conical surface having its apex located at its center and being concave in shape extending in the direction departing farther from said supporting member.

9. A pickup cartridge according to claim 1, in which:

said first surface of the armature magnet represents a surface projecting progressively toward said supporting member as it goes from its marginal edge portion toward its center, that surface of said supporting member which faces said second surface is formed into a convex surface projecting pregressively toward said armature magnet as it approaches closer to the base end of said cantilever, said damping member has a thickness progressively increasing as it goes from its center toward its marginal edge portion.

10. A pickup cartridge according to claim 9, in which:

said first surface of the armature magnet represents a conical surface having its apex located at its center, said projecting surface of said supporting member represents a conical surface having its apex located at its portion facing said cantilever, and the bilateral surfaces of said damping member are provided in the form of a concave conical surface having its apex located at its center.

11. A pickup cartridge according to claim 1, in which:

said pole pieces are fixec to said supporting member, respectively, and they have magnetic coupling portions exposed on the side surfaces of said supporting member for magnetic coupling, and said yoke is magnetically coupled to each of said pole pieces at said magnetic coupling portions of these pole pieces to thereby form said closed magnetic path.

12. A pickup cartridge according to claim 11, in which:

said yoke has lug portions facing the side surfaces of said supporting member, and the foremost ends of these lug portions engage said magnetic coupling portion of said pole pieces to thereby magnetically couple said yoke to said pole pieces.

13. A pickup cartridge according to claim 11, in which:

said yoke has lug portions engaging the outer sides of said supporting member to magnetically couple said supporting member to said yoke, keeping the yoke at said specific position relative to said supporting member.

14. A pickup cartridge according to claim 13, in which:

the respective one ends of said lug portions are coupled by a member made with a magnetic material, said coil is applied around this member, and under the state in which said yoke is magnetically coupled to said supporting member by said lug portions of the yoke with said specific positional relationship, said lug portions engage said magnetic coupling portion of said pole pieces to thereby couple said pole pieces to said yoke magnetically.

15. A pickup cartridge comprising:

an armature formed as a permanent magnet;

a supporting member for supporting said armature magnet;

a damping member made with an elastic material for damping the movement of said armature magnet and positioned between said supporting member and a first surface of said armature magnet, which first surface facing said damping member;

a cantilever secured to said armature magnet and having its foremost end provided with a stylus tip and having its base end positioned at substantially the center of said first surface of the armature magnet;

position insuring means for insuring the position of the base end of said cantilever relative to said supporting member and permitting the free movement of said cantilever centering around said base end thereof;

pole pieces facing a second surface of said armature magnet at positions close to this second surface and arranged symmetrically with respect to said cantilever so that an area of each of said pole pieces facing said second surface of the armature magnet is constant irrespective of vibration of the armature magnet, which second surface does not face said damping member;

a yoke magnetically coupled to said pole pieces for constituting a closed magnetic path for the passage of the magnetic flux emitting from said armature magent, said yoke being arranged at a specific position relative to said supporting member; and a coil applied around said yoke for inducing a signal corresponding to the variation of the magnetic flux passing through said yoke, said second surface of the armature magent representing a substantially conical surface using said cantilever as its center axis, said pole pieces pointing to the base end of said cantilever and having said second surface of the armature magnet at positions close to this second surface.

16. A pickup cartridge comprising:

an armature formed as a permanent magnet;

a supporting member for supporting said armature magnet;

a damping member made with an elastic material for damping the movement of said armature magnet and positioned between said supporting member and a first surface of said armature magnet; which first surface facing said damping member;

a cantilever secured to said armature magnet and having its foremost end provided with a stylus tip and having its base end positioned at substantially the center of said first surface of the armature magnet;

position insuring means for insuring the position of the base end of said cantilever relative to said supporting member and permitting the free movement of said cantilever centering around said base end thereof;

pole pieces facing a second surface of said armature magnet at positions close to this second surface and arranged symmetrically with repect to said cantilever, so that an area of each of said pole pieces facing said second surface of the armature magnet is constant irrespective of vibration of the armature magnet, which second surface does not face said damping member;

a yoke magnetically coupled to said pole pieces for constituting a closed magnetic path for the passage of the magnetic flux emitting from said armature magnet, said yoke being arranged at a specific position relative to said supporting member; and a coil applied around said yoke for inducing a signal corresponding to the variation of the magnetic flux passing through said yoke, said second surface of the armature magnet being a surface having a substantially constant radius of curvature centering around the base end of said cantilever, in the rest position of that armature, the tip portions of the pole pieces face the second surface of the armature at a position in the vicinity of the intermediate portion between the front the rear ends of the armature.

17. A pickup cartridge comprising:

an armature formed as a permanent magnet;

a supporting member for supporting said armature magnet;

a damping member made with an elastic material for damping the movement of said armature and positioned betweem said supporting member and a first surface of said armature magnet, which first surface facing said damping member.

a cantilever secured to said armature magnet and having its foremost end provided with a stylus tip and having its base end positioned at substantially the center of said first surface of the armature magnet;

position insuring means for insuring the position of the base end of said cantilever relative to said supporting member and permitting the free movement of said cantilever centering around said base end thereof;

pole pieces facing a second surface of said armature magnet at positions close to this second surface and arranged symmetrically with respect to said cantilever, so that an area of each of said pole pieces facing said second surface of the armature magnet is constant irrespective of vibration of the armature magnet, which second surface does not face said damping member;

a yoke magnetically coupled to said pole pieces for constituting a closed magnetic path for the passage of the magnetic flux emitting from said armature magnet, said yoke being arranged at a specific position relative to said supporting member; and a coil applied around said yoke for inducing a signal corresponding to the variation of the magnetic flux passing through said yoke, said second surface of the armature magnet representing a substantially conical surface using said cantilever as its center axis and having its apex located at a position in the extension of the base end of said cantilever, in the rest position of the armature, the tip portions of the pole pieces face the second surface of the armature at a position in the vicinity of the intermediate portion between the front and rear ends of the armature.

* * * * *